US011624578B1

(12) United States Patent
Dallenbach

(10) Patent No.: US 11,624,578 B1
(45) Date of Patent: Apr. 11, 2023

(54) ADJUSTABLE FIREARM STEADY REST

(71) Applicant: Wally Dallenbach, Basalt, CO (US)

(72) Inventor: Wally Dallenbach, Basalt, CO (US)

( * ) Notice: Subject to any disclaimer, the term of this patent is extended or adjusted under 35 U.S.C. 154(b) by 0 days.

(21) Appl. No.: 17/687,965

(22) Filed: Mar. 7, 2022

(51) Int. Cl.
*F41A 23/16* (2006.01)

(52) U.S. Cl.
CPC ..... *F41A 23/16* (2013.01)

(58) Field of Classification Search
CPC ..... F41A 23/16
See application file for complete search history.

(56) References Cited

U.S. PATENT DOCUMENTS 503,338 A * 8/1893 Woods ..... A01K 97/10 248/299.1
937,480 A * 10/1909 Smith, et al. ..... F16M 13/02 211/119.006
1,890,423 A * 12/1932 Teagarden ..... F41A 23/00 248/354.6
2,898,069 A * 8/1959 Kramer ..... G09F 1/14 248/314
2,913,740 A * 11/1959 Eldridge ..... A61G 7/0503 24/339
3,225,656 A * 12/1965 Johnt ..... F41A 23/06 89/37.04
4,913,391 A * 4/1990 Klipp ..... F41A 23/02 248/231.71
5,081,782 A * 1/1992 Wright ..... F41A 23/16 42/94
5,481,817 A * 1/1996 Parker ..... F41A 23/02 248/286.1
5,740,625 A * 4/1998 Jenkins ..... F41A 23/04 42/94
5,933,999 A * 8/1999 McClure ..... F41A 23/02 42/94
6,032,911 A * 3/2000 Osborne ..... F41A 23/18 248/229.15
6,338,218 B1 * 1/2002 Hegler ..... F41A 23/16 89/37.04
7,165,750 B2 * 1/2007 McCuskey ..... F41A 23/18 248/214
9,417,025 B1 * 8/2016 McDonald ..... F41A 23/02
9,625,229 B1 * 4/2017 Hilz ..... F41A 23/02
9,976,693 B1 * 5/2018 Delikat ..... A01M 31/02
10,209,023 B1 * 2/2019 Stuart ..... F41A 23/18
2009/0026679 A1 * 1/2009 Harman, III ..... F41C 27/00 269/74
2011/0308131 A1 * 12/2011 McLinda ..... F41A 23/06 42/94
2012/0119427 A1 * 5/2012 Weissenborn ..... A63C 11/04 269/95
2012/0227305 A1 * 9/2012 Fontenot ..... F41A 23/02 42/94

(Continued)

*Primary Examiner* — Joshua E Freeman
(74) *Attorney, Agent, or Firm* — J. Wiley Horton

(57) ABSTRACT

An adjustable shooting steady rest configured to clamp to a wide variety of structures. The steady rest includes a chassis with one or more clamps opposing a clamping bracket. The user places the chassis over a structure such as a safety bar or windowsill. The user then tightens the clamp(s) to lock the chassis in place. The chassis includes a rod receiver. A rod is adjustably attached to the rod receiver. A firearm support is provided on the upper portion of the rod.

15 Claims, 13 Drawing Sheets

(56) References Cited

U.S. PATENT DOCUMENTS

| | | | | |
|---|---|---|---|---|
| 2016/0069632 | A1* | 3/2016 | Williams | F41A 23/16<br>42/94 |
| 2017/0356714 | A1* | 12/2017 | Linderwell | F41A 23/06 |
| 2018/0125061 | A1* | 5/2018 | Komater | F16M 11/28 |
| 2018/0224062 | A1* | 8/2018 | Yokiel | F16M 11/24 |
| 2020/0054001 | A1* | 2/2020 | LeBire | F41A 23/06 |
| 2020/0056857 | A1* | 2/2020 | Stubbs | F16M 13/022 |

* cited by examiner

ADJUSTABLE FIREARM STEADY REST

BACKGROUND OF THE INVENTION

1. Field of the Invention

This invention relates to the field of shooting. More specifically, the invention comprises an adjustable firearm support that can be attached to a variety of structures.

2. Description of the Related Art

Those familiar with the shooting sports know that the use of a steady rest greatly increases firearm accuracy. FIGS. 1 and 2 illustrate scenarios in which a steady rest would be beneficial. FIG. 1 illustrates a prior art tree stand 10. There are many different types of tree stand. Most, however, include a seat assembly 12, a foot plate 14, and a safety bar 16. The example shown in FIG. 1 includes a ladder. Hunter 18 climbs the ladder and sits in seat assembly 12. Safety bar is in a raised position when the hunter enters or exits the tree stand.

Once seated, the hunter pivots safety bar 16 down to the position shown. The safety bar is pivotally attached to the stand by a pair of pivot joints 15—only one of which is visible in FIG. 1. The safety bar is held in place by gravity. It actually provides a suitably stable rest point for shooting, but its position is too low. The hunter in FIG. 1 has assumed a typical shooting stance required to aim and fire rifle 20 from a tree stand. Trigger hand 22 is closed around the grip just to the rear of the trigger guard. Support hand 24 rests beneath the rifle's forend. This is in effect a modified "offhand" shooting position. It cannot be considered a seated shooting position because the hunter's elbows cannot be rested on any portion of the hunter's legs. Offhand is an unstabilized shooting position that significantly limits accuracy.

FIG. 2 shows a second common scenario. Shooting blind 26 conceals hunter 18. Opening 28 is provided for viewing and shooting. When a shot is to be taken, hunter 18 extends rifle 20 through opening 28. Sill 30 can provide a steady rest. A towel or sandbag is sometimes placed on the sill or on a shelf provided on the inside of the blind just below the sill. These devices do provide stability but are often cumbersome and inflexible to use. The result is that the hunter may wind up shooting off-hand as depicted in FIG. 2.

Many other shooting scenarios do of course exist, and the invention is by no means limited to the particular applications depicted. However, in general, it is desirable to provide a portable steady rest that can be clamped to a variety of structures and adjusted in height. The present invention provides such a device.

BRIEF SUMMARY OF THE INVENTION

The present invention comprises an adjustable shooting steady rest configured to clamp to a wide variety of structures. The steady rest includes a chassis with one or more clamps opposing a clamping bracket. The user places the chassis over a structure such as a safety bar or windowsill. The user then tightens the clamp(s) to lock the chassis in place. The chassis includes a rod receiver. A rod is adjustably attached to the rod receiver. A firearm support is provided on the upper portion of the rod. The firearm support is configured to support a suitable portion of a firearm—such as a rifle forend or barrel. The user adjusts the rod's position to provide a desired height for the firearm support.

REFERENCE NUMERALS IN THE DRAWINGS

Figure 1:
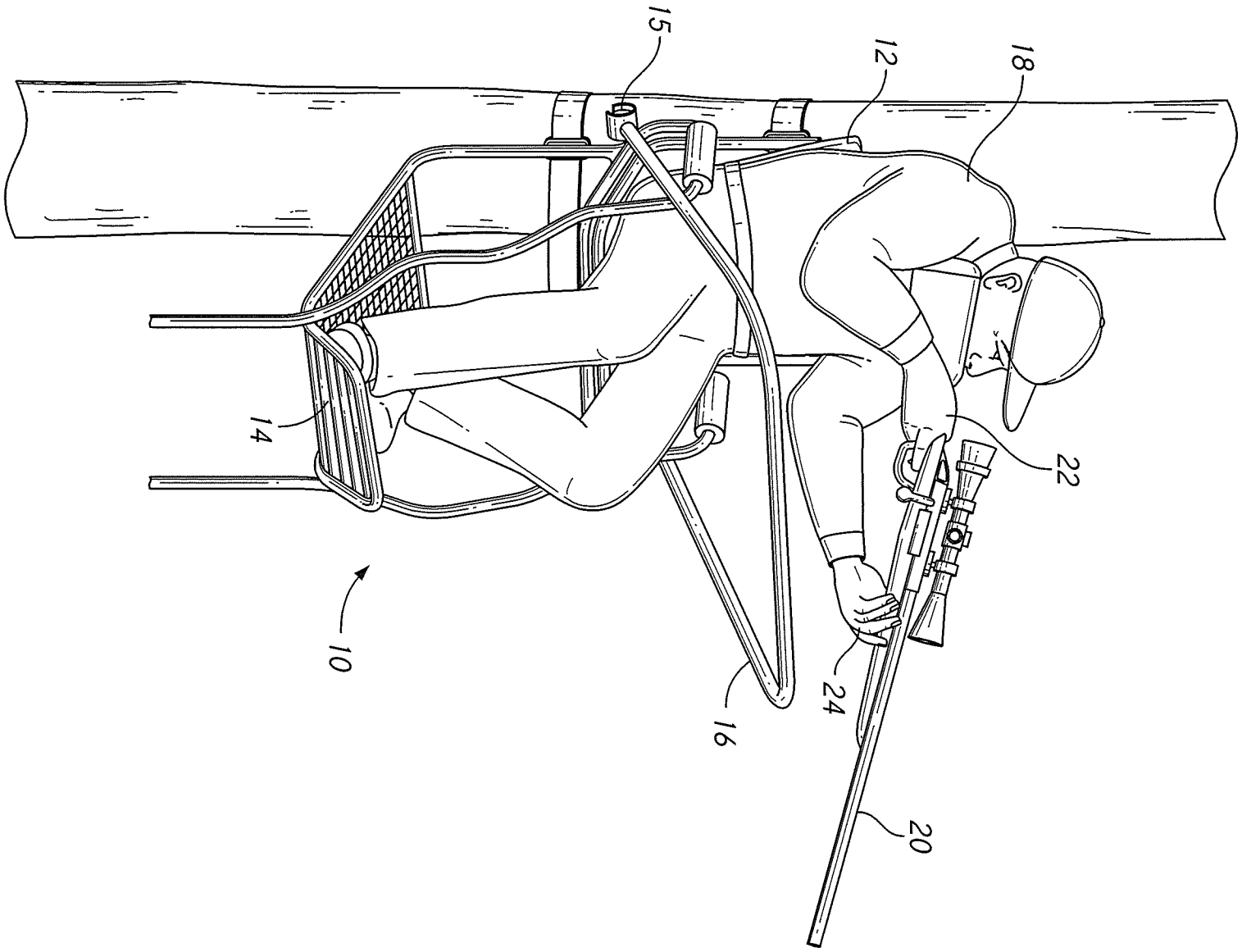
FIG. 1 (Prior Art)
FIG. 1 is a perspective view, showing a hunter in a prior art tree stand.

10 tree stand
12 seat assembly
14 foot plate
15 pivot joint
16 safety bar
18 hunter
20 rifle
21 forend
22 trigger hand
24 support hand
26 shooting blind
28 opening
30 sill
32 steady rest
34 chassis
36 span leg
38 clamp mount leg
40 back leg
42 clamping bracket
43 first leg
44 screw clamp
45 second leg
46 screw clamp
48 insert
50 insert
52 threaded rod
54 rod receiver
56 firearm support
58 foot

60 large tube
62 small tube
64 square tube
66 tip
68 tip
70 weld
72 weld
74 weld
76 weld
79 barrel
80 insert
82 insert
84 female thread
86 female thread
88 tube
90 smooth rod
92 insert
94 insert
96 spring
98 inner slot
100 outer slot
102 hole
104 lock plate
106 hole
108 lock plate
110 release
112 fulcrum
114 shelf

DETAILED DESCRIPTION OF THE INVENTION

The present invention can be physically realized in a wide variety of embodiments. The following description provides details of a few of these. Many more embodiments will occur to those skilled in the art upon reviewing this disclosure. The scope of the invention should therefore be fixed by the claims rather than the descriptions of the disclosed embodiments.

Figure 3:
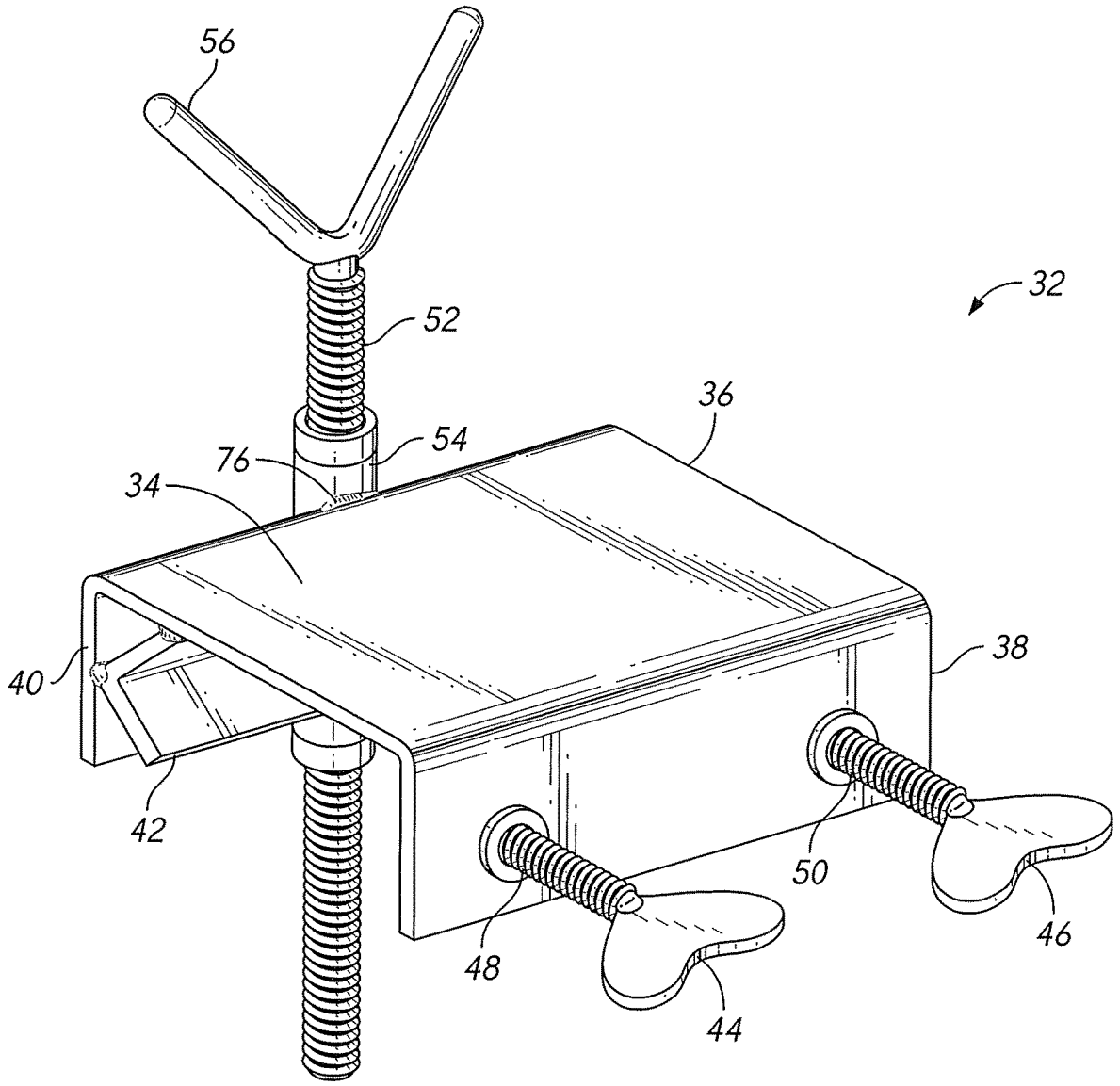
FIG. 3 is a perspective view, showing a first embodiment of the inventive steady rest.

In general, the invention includes (1) a chassis configured to clamp to a variety of external structures, and (2) an adjustable rod extending from the chassis, with a firearm support being provided on the rod. FIG. 3 shows a first embodiment of steady rest 32. Chassis 34 in this version is a section of C-channel. The three legs of the C-channel are clamp mount leg 38, span leg 36, and bracket leg 40.

Span leg 36 will ordinarily be placed above the external structure. Bracket leg 40 will normally be placed on the side of the external structure that is opposite to the position of the hunter. Clamp mount leg 38 will normally be placed on the same side of the external structure as the hunter. The reader should bear in mind, however, that directional terms such as "above" are arbitrary as steady rest 32 can be attached in a variety of orientations.

Clamp mount leg 38 in this example mounts a pair of screw clamps 44,46. Threaded inserts 48, 50 are pressed into clamp mount leg 38. Each insert includes a threaded through-hole sized to accommodate the threads of a screw clamp. Clamping bracket 42 is attached to bracket leg 40. In operation, the screw clamps 44,46 squeeze the external structure against clamping bracket 42—thereby attaching steady rest 32 to the external structure.

A central purpose of the steady rest is the provision of a stable firearm support 56. In the example of FIG. 3, firearm support 56 is provided on an end of threaded rod 52. Threaded rod 52 is adjustably attached to rod receiver 54. Rod receiver 54—in turn—is connected to chassis 34. The rod receiver includes an internal female thread that engages the male thread on threaded rod 52. The extension of threaded rod 52 above the position of chassis 34 is accomplished by turning threaded rod 52. For the embodiment shown the threaded rod is given a right-hand thread. Turning the threaded rod in a clockwise direction moves the threaded rod downward and turning the threaded rod in an anti-clockwise direction moves the threaded rod upward.

Figure 4:
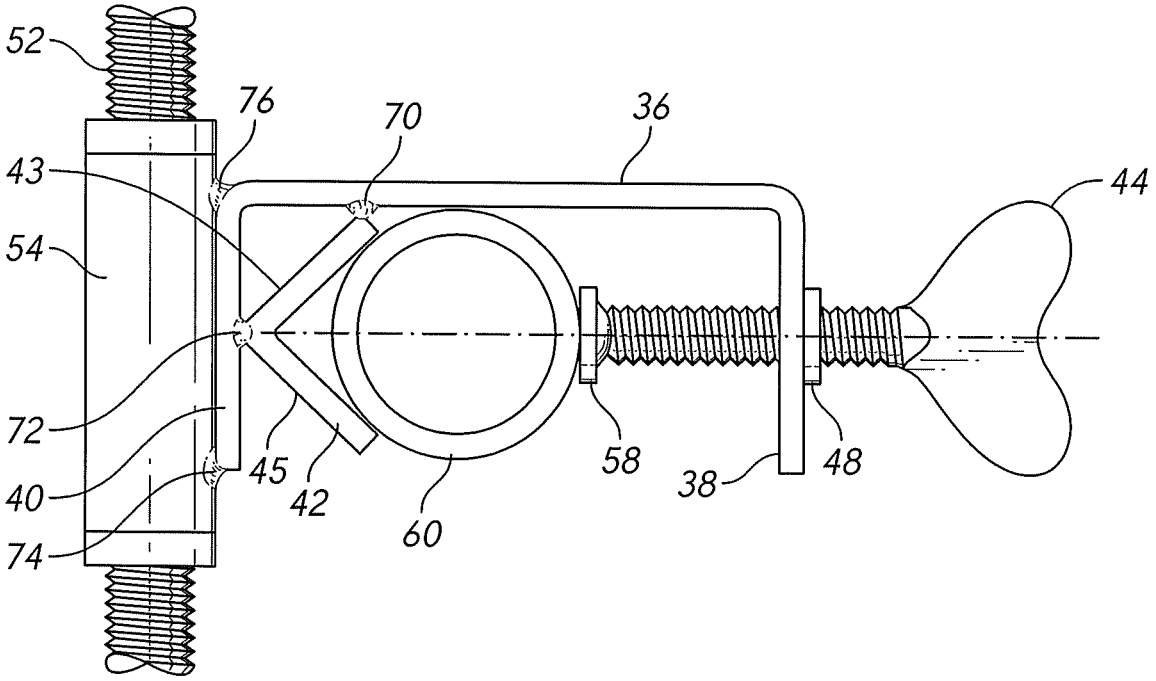
FIG. 4 is a side elevation view, showing the embodiment of FIG. 3 clamped to a large tube.

Clamping bracket 42 allows the chassis to be clamped to a wide variety of external structures. FIGS. 4-7 provide examples of some of these external structures. In the example of FIG. 4, the invention is being clamped to large tube 60—the large tube being the external structure in this case. Large tube 60 is part of the safety bar on a tree stand. It has an external diameter of 1.250 inches (31.75 mm).

Clamp bracket 42 is fixedly attached to bracket leg 40 and span leg 36 by welds 72 and 70 respectively. These welds are preferably just small welds made at each end of the C-channel and clamp bracket 42. The clamp bracket in this example is a simple angle piece having first leg 43 and second leg 45. The clamp bracket is rotated 45 degrees so that first leg 43 is rotated 45 degrees with respect to bracket leg 40. The intersection of the two bracket legs 43,45 lies on the central axis of screw clamp 44. When screw clamp 44 is tightened, foot 58 is pressed against large tube 60 and clamp bracket 42 is pulled against large tube 60 as shown. The result is that three points of contact are established around the perimeter of the tube—thereby providing a solid engagement.

FIG. 4 also shown how rod receiver 54 is joined to the C-channel in this embodiment. Two welds 74,76 are made between the rod receiver and the C-channel. These are made at the point of tangency for rod receiver 54 (which in this example is a hollow tube).

Figure 5:
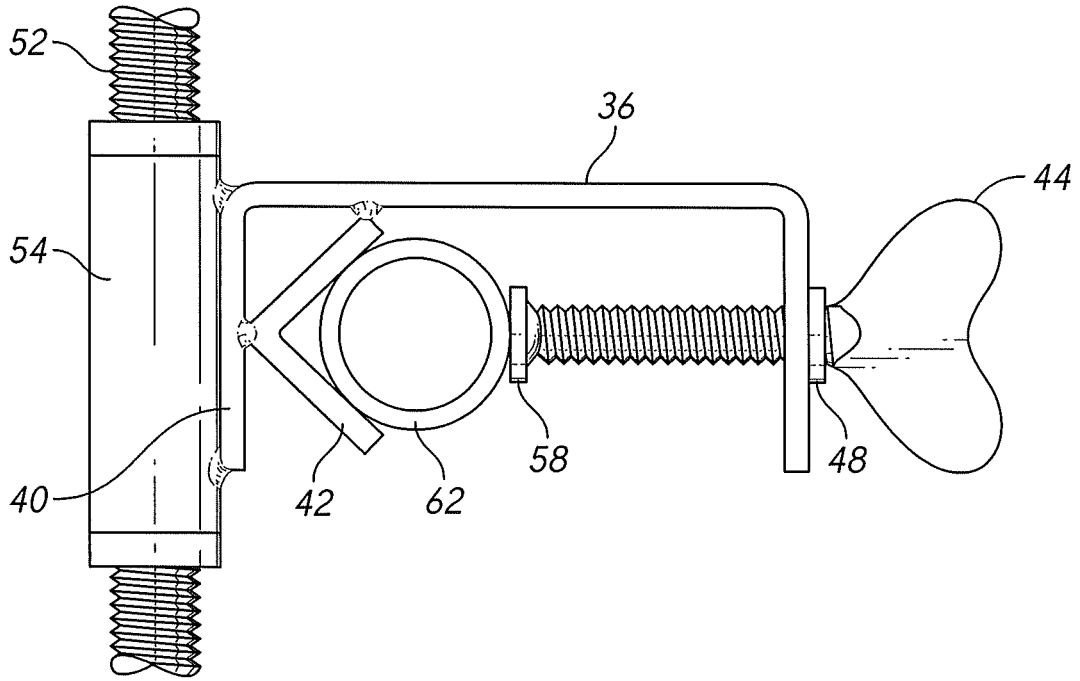
FIG. 5 is a side elevation view, showing the embodiment of FIG. 3 clamped to a small tube.

FIG. 5 shows the same embodiment being clamped to small tube 62. Small tube 62 has an outside diameter of 0.875 inches (22.22 mm). Clamp bracket 42 accommodates the small tube. Tightening screw clamp 44 again propels foot 58 against the side of the tube—creating three points of contact and a solid engagement. The example shown works well for even smaller tubes—such as one having an outside diameter of only 0.500 inches (12.70 mm).

Figure 6:
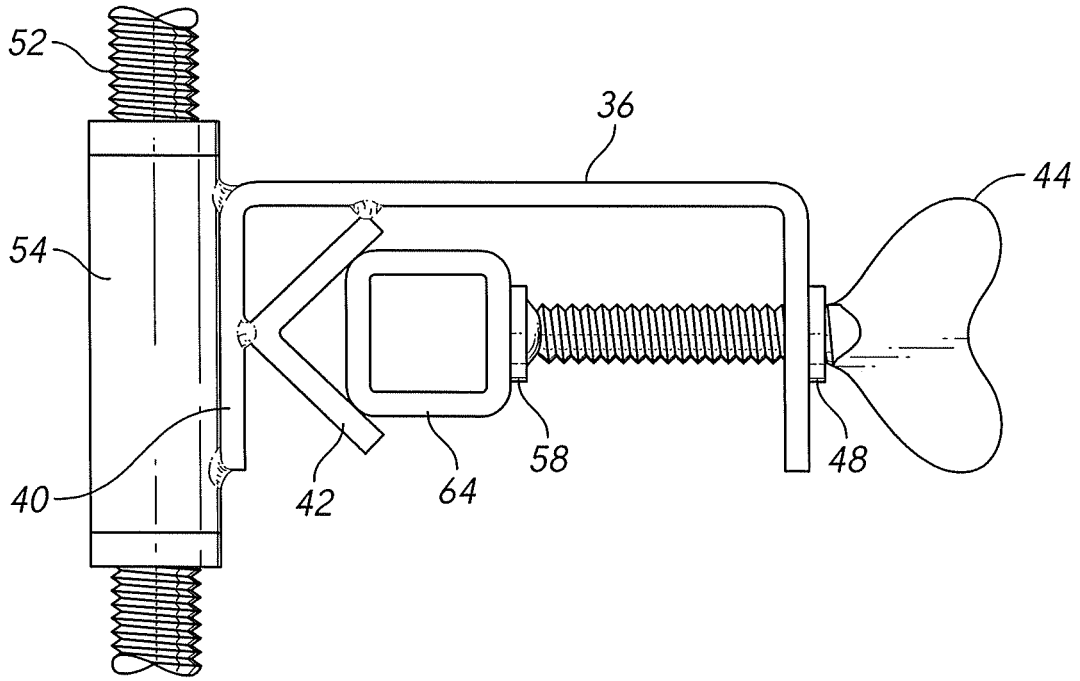
FIG. 6 is a side elevation view, showing the embodiment of FIG. 3 clamped to a square tube.

FIG. 6 shows the same embodiment being clamped to square tube 64. Square tube 64 has external dimensions of 1.000 inches by 1.000 inches (25.40 mm by 25.40 mm). Clamp bracket 42 accommodates this shape as well—again creating three points of solid contact around the perimeter of the external structure being clamped.

Figure 2:
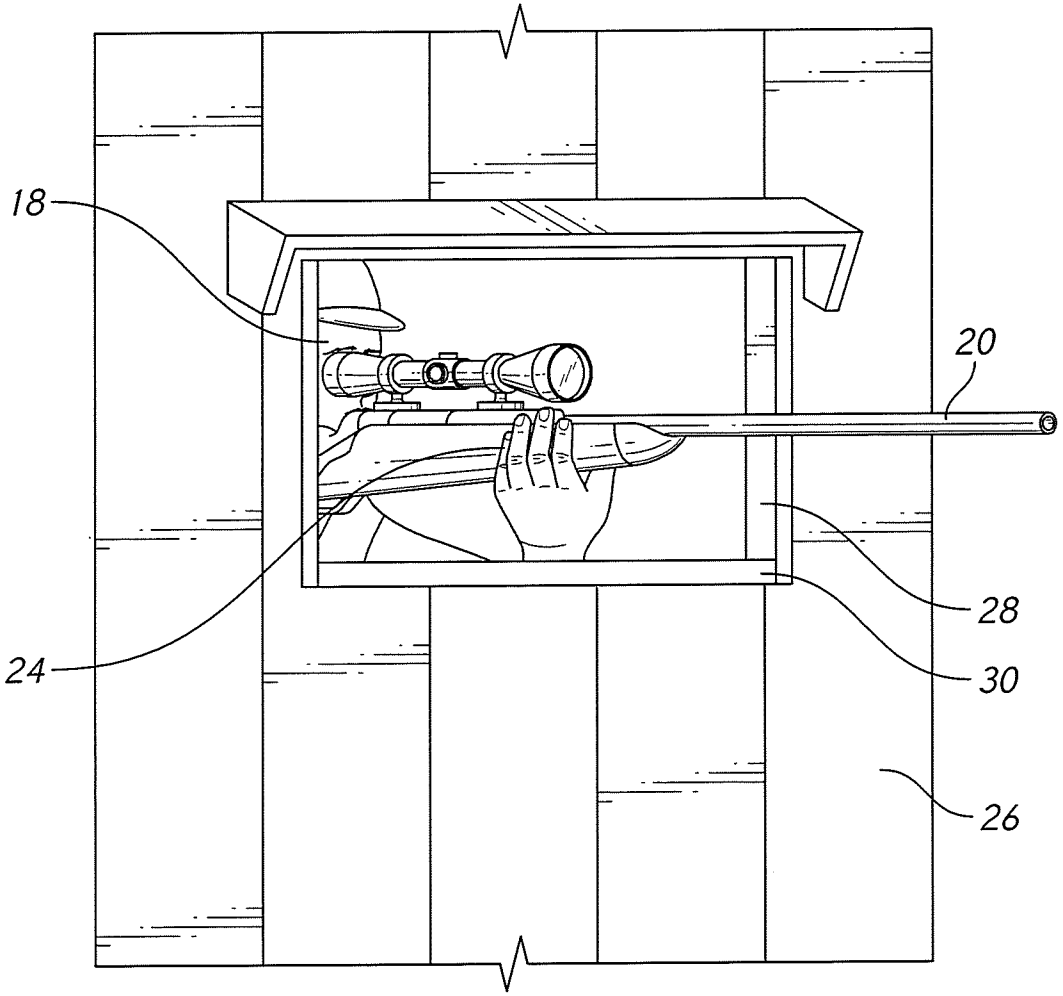
FIG. 2 (Prior Art)
FIG. 2 is a perspective view, showing a hunter in a prior art shooting blind.
Figure 7:
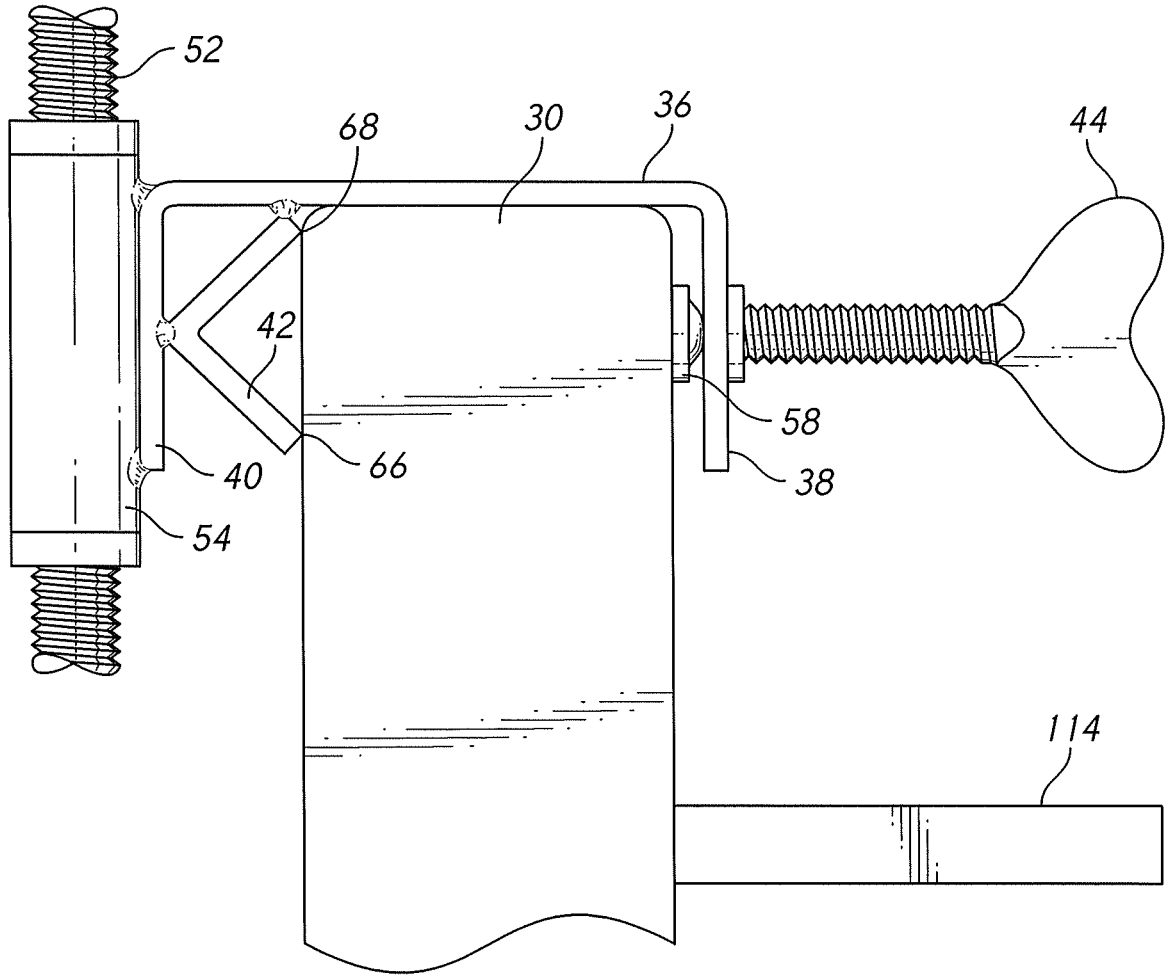
FIG. 7 is a side elevation view, showing the embodiment of FIG. 3 clamped to a sill.

The examples of FIGS. 4-6 apply to tubes commonly used for the safety bar and other structures in tree stands. FIG. 7 pertains to structures such as are present in a blind like the one seen in FIG. 2. FIG. 7 shows the region of sill 30. Most blinds have some sort of sill across the bottom of each opening. These are often thicker than the tubes found in tree stands. A typical sill is 1.000 inches to 1.750 inches thick (25.40 mm to 44.45 mm). Span leg 36 is made long enough to accommodate a sill in the clamping gap. In the example shown, two tips 66,68 of the legs of clamp bracket 42 bear against the outward facing side of sill 30. Foot 58 bears against the inward facing side of the sill when screw clamp 44 is tightened.

Many blinds include a shelf 114 just below sill 30. Such a shelf is useful for holding loose items like binoculars and ammunition boxes. However, such a shelf can also interfere with the operation of rod 52 if rod receiver 54 is placed on the side of the chassis that customarily resides inside the blind. For this reason, rod receiver 54 is places on the side of the chassis that customarily resides outside the blind. The screw clamps are placed on the side that customarily resides inside the blind—so they can be more easily accessed by the hunter.

Figure 8:
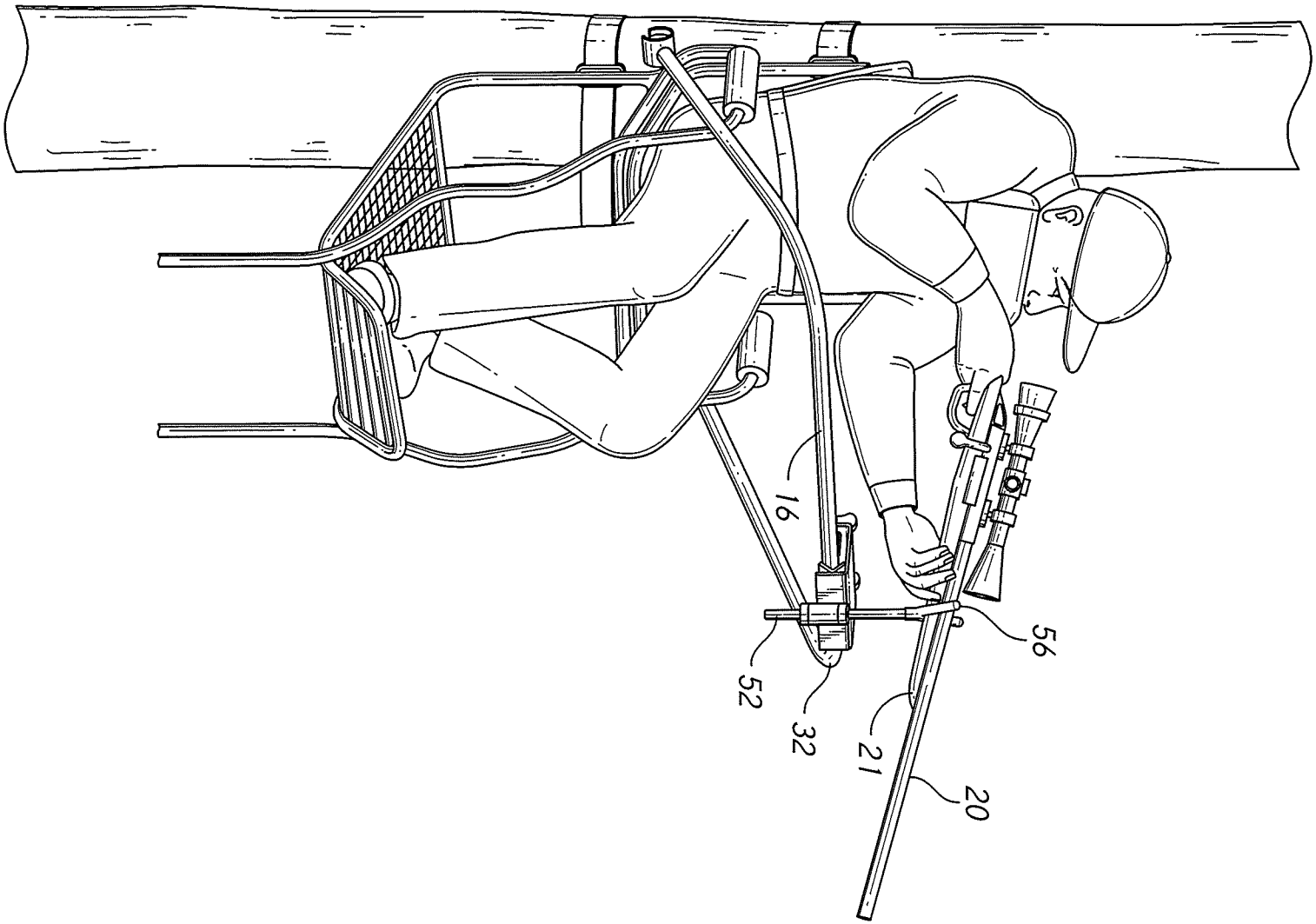
FIG. 8 is a perspective view, showing the invention clamped to a safety bar on a tree stand.
Figure 9:
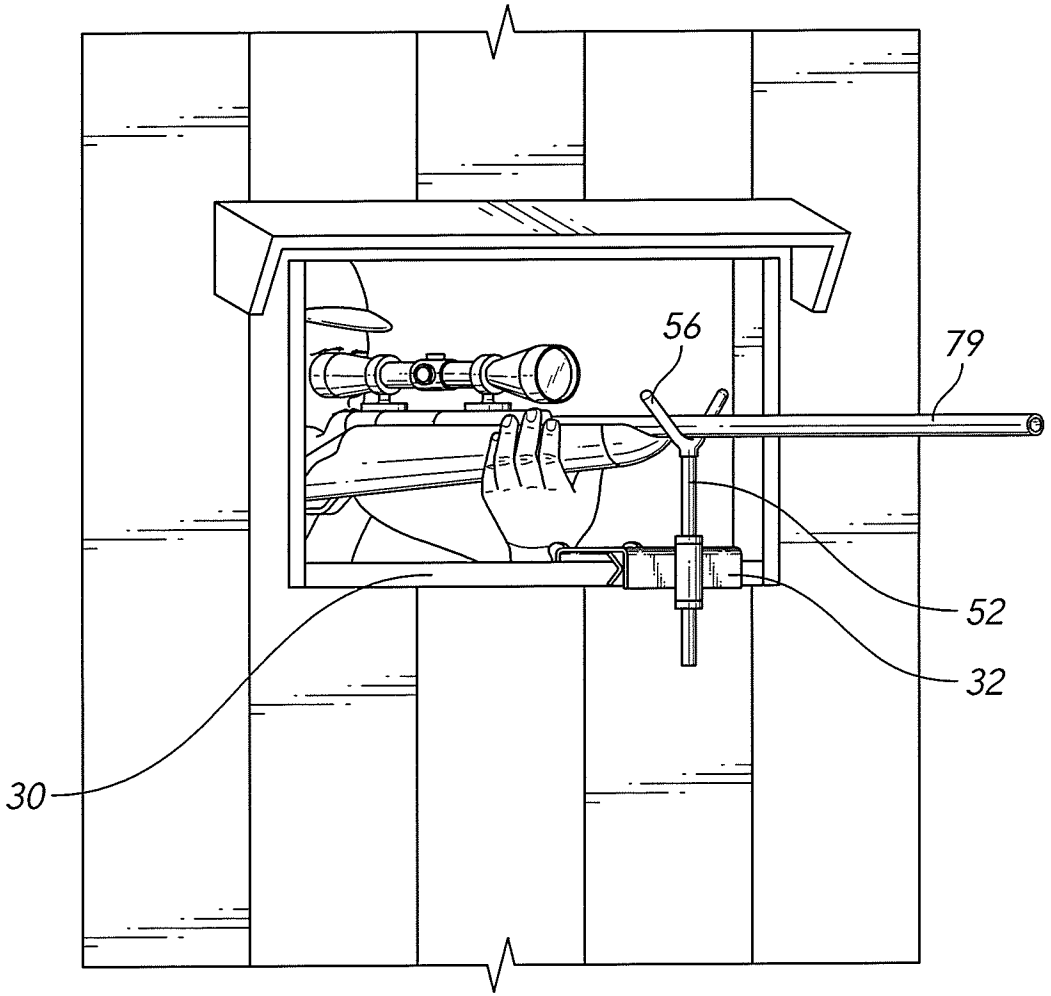
FIG. 9 is a perspective view, showing the invention clamped to a sill in a shooting blind.

FIGS. 8 and 9 show the invention in use. In FIG. 9, steady rest 32 has been clamped to safety bar 16 of a tree stand. Threaded rod 52 has been adjusted vertically to place firearm support 56 at a desired height. Forend 21 of the rifle is placed on the firearm support and a steady shooting configuration is thereby created.

FIG. 9 shows the invention in use in a blind. Steady rest 32 has been clamped to sill 30. Threaded rod 52 has again been adjusted to a desired height for firearm support 56. In this example, rifle barrel 79 is actually placed in the support 56. A stable shooting configuration is again thereby created.

Figure 10:
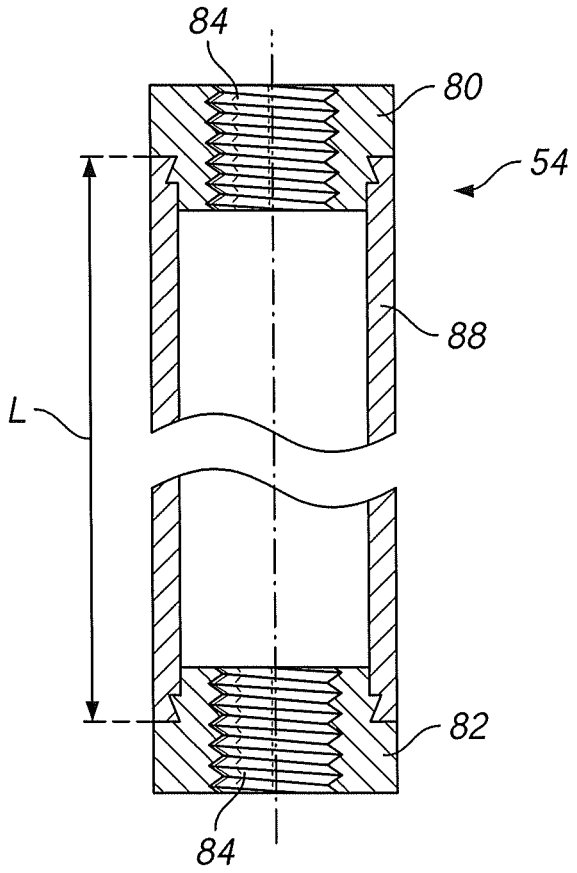
FIG. 10 is a sectional elevation view, showing an embodiment of the rod receiver using threaded inserts.
Figure 11:
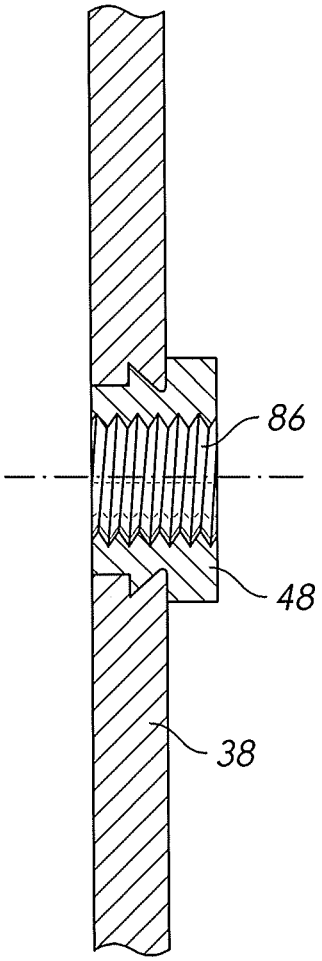
FIG. 11 is a sectional elevation view, showing an embodiment of the clamp mount leg using threaded inserts.

FIGS. 10 and 11 illustrate some construction details for the exemplary embodiment of FIG. 3. It is desirable to minimize the weight of steady rest. To that end, aluminum can be used for the chassis. Aluminum, however, may not provide adequate thread strength for the clamp screws. Inserts can be used to provide adequate thread strength and to minimize the need for potentially expensive threading operations.

FIG. 10 provides a sectional elevation view through the middle of rod receiver 54. In this version a simple hollow tube 88 provides the structure. Insert 80 is pressed into the open upper end of the tube. It includes female thread 84. Insert 82 is pressed into the open lower end of the tube. The two inserts include a female threaded passage 84. The length L of the hollow tube is set so that the threads in insert 82 align with the helical path of the threads in insert 80. This alignment allows a single threaded rod 52 to thread through insert 80 and insert 82.

In the preferred embodiments inserts 80, 82 are clinching steel inserts such as are manufactured by Penn Engineering and Materials, Inc., of Danboro, Pa., U.S.A. These inserts are assembled by providing (such as by punching or drilling) a properly sized hole and squeezing the insert into the hole (using fixturing on both sides). The insert plastically deforms the perimeter of the hole and becomes clinched to the base material.

FIG. 11 shows another similar insert that is pressed into clamp mount leg 38 in order to engage the threads of a screw clamp. Insert 48 has female thread 86 that is configured to match the thread of the screw clamps. Insert 48 is clinched to the material for clamp mount leg 38. The engagement is quite strong, so that the insert can withstand the forces generated by the screw clamp and transmit them to the chassis.

Figure 12:
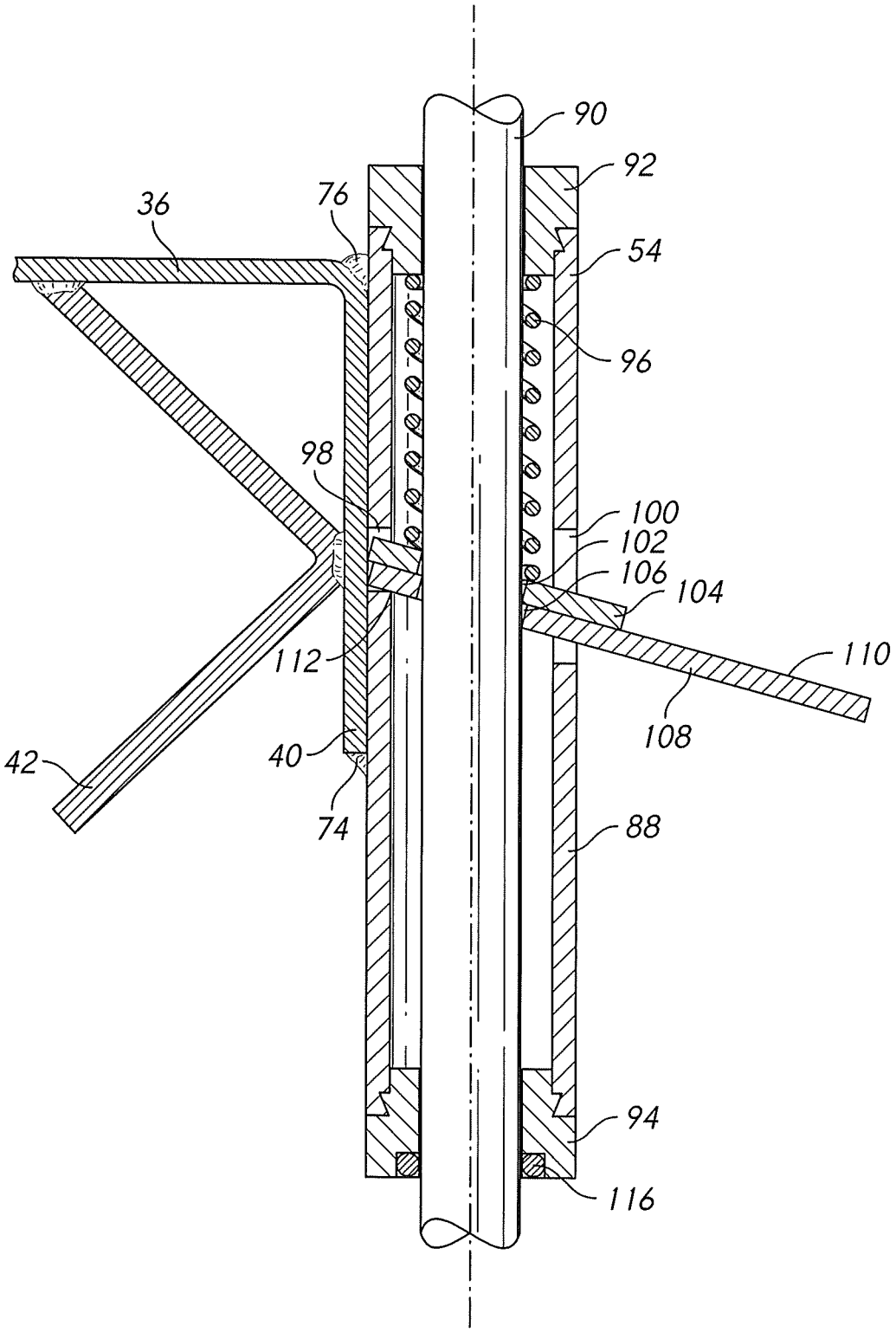
FIG. 12 is a sectional elevation view, showing an alternate embodiment for the adjustable attachment between the rod and the rod receiver.
Figure 13:
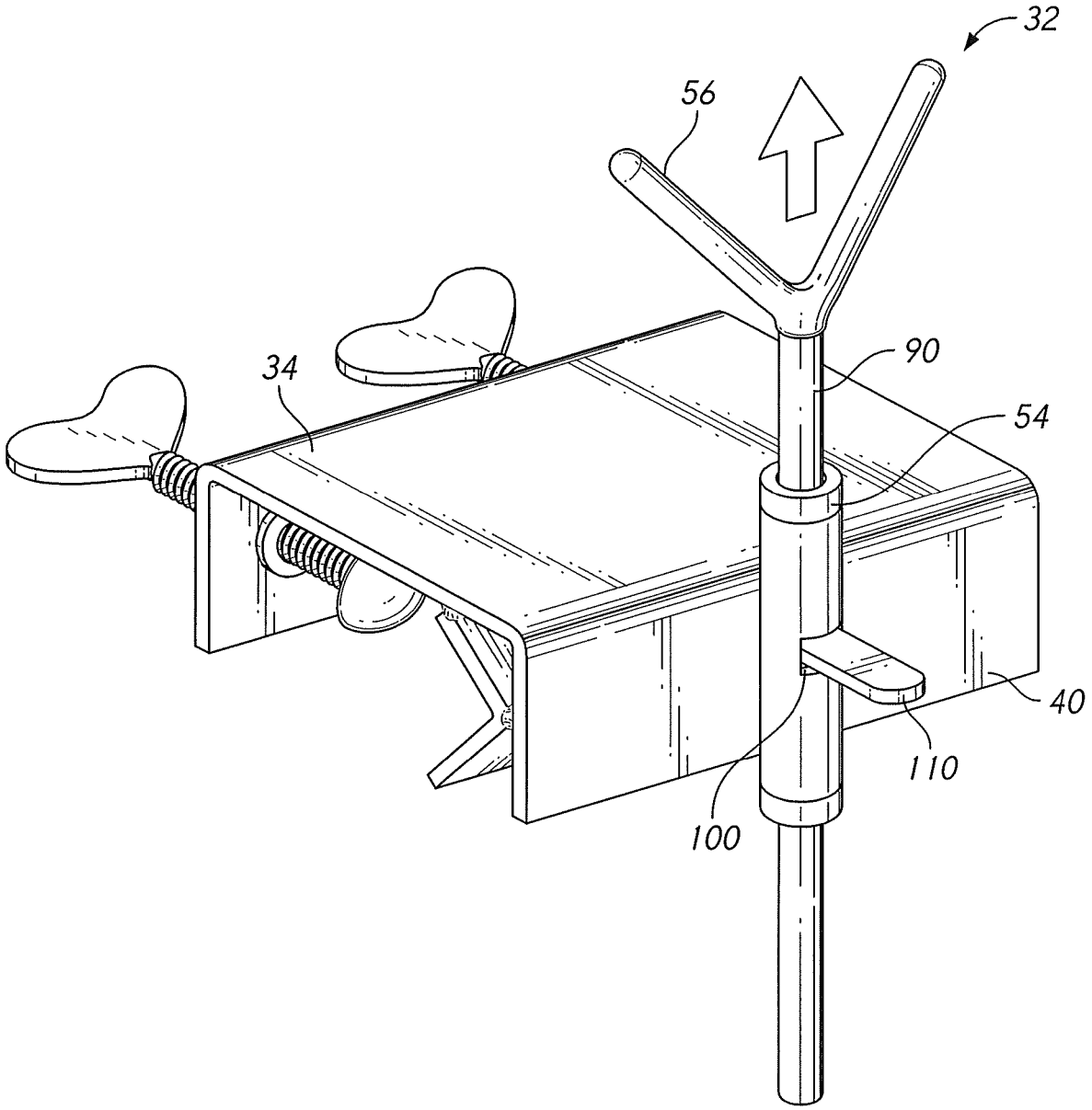
FIG. 13 is a perspective view, showing an upward adjustment of the rod in the version of FIG. 12.
Figure 14:
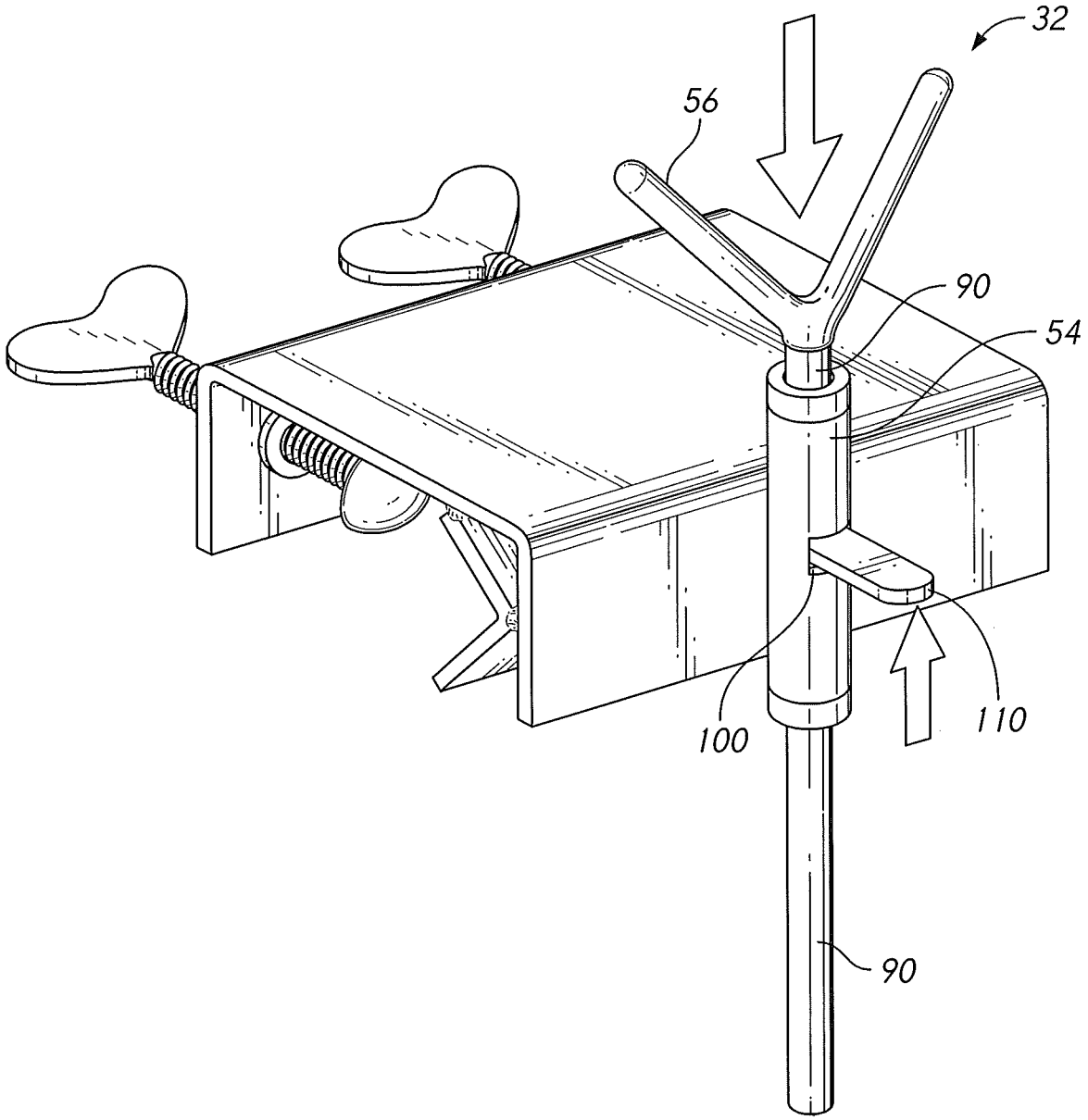
FIG. 14 is a perspective view, showing a downward adjustment of the rod in the version of FIG. 12.

The example of FIGS. 3-11 used a threaded engagement to provide the adjustment between rod 52 and rod receiver 52. This is a very practical and robust adjustable engagement. Other adjustable engagements are possible, however. FIGS. 12-14 illustrate one of these other options.

The embodiment of FIGS. 12-14 uses a modified rod receiver. FIG. 13 is a perspective view of this embodiment. Rod receiver 54 is again attached to chassis 34—such as by welding. FIG. 12 is a sectional view through the middle of rod receiver 54. Smooth rod 90 has been substituted for threaded rod 52. Insert 92 is pressed into the top of tube 88 and insert 94 is pressed into the bottom. The inserts 92,94 are preferably clinching steel inserts as described previously. However, each insert 92,94 has a smooth bore through its center rather than a threaded bore. Smooth rod 90 is configured to smoothly slide through the two inserts. The bore through the two inserts 92,94 in this example is 0.380 inches (9.652 mm). The diameter of the smooth rod in this example is 0.372 inches (9.449 mm). This combination allows guided but smooth motion of smooth rod 90 within inserts 92,94.

A unidirectional latch is incorporated to hold rod 90 in position once a desired elevation has been set. The unilateral latch in this example is similar to the lock plate latch used in the drive mechanism of many caulking guns. Lock plate 108 is provided with a hole that is slightly larger than the diameter of smooth rod 90. Stacking lock plate 104 is provided with a hole 102 of the same diameter. In this example, the diameter of holes 102,106 is 0.390 inches (9.906 mm). Inner slot 98 is provided in tube 88 proximate mounting leg 40. Outer slot 100 is provided in the opposite side of the tube.

The ends of the two lock plates 104,108 nearest mounting leg 40 rest within inner slot 98. The lower portion of inner slot 98 becomes fulcrum 112. Compression spring 96 is sized to slide over smooth rod 90. This spring is compressed between the lower portion of insert 92 and lock plate 104. The spring tends to urge the two lock plates 104, 108 downward. The end of lock plate 108 within inner slot 98 is urged against fulcrum 112 and its further downward motion is thereby arrested. The two lock plates then pivot in an anticlockwise position until further pivoting is prevented by the edges of holes 102,106 binding against smooth rod 90.

In studying the geometry of FIG. 12, those skilled in the mechanical art will readily appreciate the following: (1) If a user grasps smooth rod 90 and pulls it upward, the rod will slide smoothly upward through the unidirectional latch created by the two lock plates, (2) If a user attempts to push smooth rod 90 downward, the two lock plates will immediately bind against the rod and prevent further downward motion. Thus, rod 90 can move up but cannot move down.

Of course, there will be times when the user wishes to move smooth rod 90 down. Release 110—which is simply an extension of lock plate 108 is provided for this purpose. If the user urges release 110 upward, then the edges of holes 102, 106 will disengage from their binding position against smooth rod and the smooth rod will be free to descend. Significantly, however, the user has to keep release 110 in a raised position in order for rod 90 to descend. As soon as the user lets go of release 110, spring 96 will pivot the lock plates back to the position shown in FIG. 12 and any further downward motion of rod 90 will be prevented.

FIGS. 13 and 14 illustrate the practical application of this unidirectional latch. In FIG. 13, the user wishes to raise the position of firearm support 56. The user simply grabs the support—or some portion of smooth rod 90—and pulls it upward. The support freely moves upward and remains in position when it is released. Thus, the user is able to incrementally adjust firearm support 56 upward until a desired position is reached.

FIG. 14 shows a lowering operation. In order to lower firearm support 56, the user must pull up on release 110 as indicated by the arrow. Rod 90 is then free to move down. The speed of descent can be regulated by introducing a frictional element. As an example, insert 94 can include a polymer O-ring that bears against smooth rod 90 and slows its descent when the unidirectional latch is released. Returning to FIG. 12, an exemplary O-ring 116 is provided within insert 94. In this example, a DELRIN O-ring is used. This O-ring adds friction so that the rod and attached firearm support does not abruptly drop when release 110 is pulled upward. The reader will thereby appreciate that the user can rapidly and easily adjust the position of rifle support 56 using the unidirectional latch and the selective release 110.

Many other features and combinations of features can be provided for the invention. Examples include:

1. Aluminum can be used for chassis 34 and steel for the adjustable rod extending from the rod receiver.

2. The weldment shown for the chassis can be a unified piece made by various processes—such as extrusion.

3. The holes in the lock plates can be slots instead.

4. Many different types of screw clamps can be substituted for the type shown. An entirely different clamping mechanism can also be used—such as a caulking gun drive mechanism.

5. The firearm support can be any desired shape instead of the simple "vee" shown.

6. The firearm support can be covered with a compliant material such as a natural or synthetic rubber.

7. Many alternate designs for clamp bracket 42 can be substituted.

The preceding descriptions contain significant detail regarding the novel aspects of the present invention. They should not be construed, however, as limiting the scope of the invention but rather as providing illustrations of the preferred embodiments of the invention. Many other embodiments will occur to those skilled in the art. Thus, the scope of the invention should be fixed by the following claims, rather than by the examples given.

Having described my invention, I claim:

1. An adjustable steady rest for a user aiming a firearm, comprising:

(a) a chassis, including a clamp mount leg, a span leg, and a clamping bracket;

(b) a clamp attached to said clamp mount leg and configured to clamp against said clamping bracket;

(c) a rod receiver attached to said chassis;

(d) a rod adjustably engaged to said rod receiver, the amount of extension of said rod being adjustable by said user;

(e) a firearm support mounted on a distal end of said rod;

(f) wherein said adjustable engagement between said rod and said rod receiver comprises a male thread on said rod and a female thread on said rod receiver;

(g) wherein said rod receiver is a hollow tube having a first open end and a second open end;

(h) a first insert provided in said first open end of said hollow tube;

(i) a second insert provided in said second open end of said hollow tube;

(j) said first insert having a first female threaded passage;

(k) said second insert having a second female threaded passage; and (l) said second insert being offset from said first insert a distance so that said second female threaded passage aligns with the helical path of the threads in said first female threaded passage, thereby allowing said male thread on said rod to simultaneously engage said first female threaded passage and said second female threaded passage.

2. The adjustable steady rest as recited in claim 1, wherein:

(a) said first threaded insert is pressed into said first open end; and (b) said second threaded insert is pressed into said second open end.

3. The adjustable steady rest as recited in claim 1, wherein said clamp is a clamping screw.

4. The adjustable steady rest as recited in claim 3, wherein said clamping bracket is aligned with an axis of rotation of said clamping screw.

5. The adjustable steady rest as recited in claim 4, wherein said clamping bracket comprises:

(a) a first leg angularly offset 45 degrees in the anti-clockwise direction from said axis of rotation of said clamping screw; and (b) a second leg angularly offset 45 degrees in the clockwise direction from said axis of rotation of said clamping screw.

6. An adjustable steady rest for a user aiming a firearm, comprising:

(a) a chassis, including a clamp mount leg, a span leg, and a clamping bracket;

(b) a clamp attached to said clamp mount leg and configured to clamp against said clamping bracket;

(c) a rod receiver attached to said chassis;

(d) a rod that is translatable with respect to said rod receiver, an amount of extension of said rod from said rod receiver being selectively adjustable by said user;

(e) a firearm support mounted on a distal end of said rod; and (f) wherein said adjustable engagement between said rod and said rod receiver comprises a unidirectional latch configured to allow said user to pull said rod freely in a first direction but not in a second direction opposite said first direction.

7. The adjustable steady rest as recited in claim 6, wherein said adjustable engagement between said rod and said rod receiver comprises:

(a) said rod having a smooth, cylindrical exterior;

(b) a lock plate, including a passage configured to bind against said cylindrical exterior of said rod when said lock plate is tilted;

(c) a spring configured to bias said lock plate to said tilted position; and (d) a release configured to bias said lock plate away from said titled position.

8. The adjustable steady rest as recited in claim 7, wherein said clamp is a clamping screw.

9. The adjustable steady rest as recited in claim 8, wherein said clamping bracket is aligned with an axis of rotation of said clamping screw.

10. The adjustable steady rest as recited in claim 9, wherein said clamping bracket comprises:

(a) a first leg angularly offset 45 degrees in the anti-clockwise direction from said axis of rotation of said clamping screw; and (b) a second leg angularly offset 45 degrees in the clockwise direction from said axis of rotation of said clamping screw.

11. The adjustable steady rest as recited in claim 7, further comprising:

(a) wherein said rod receiver is a hollow tube having a first open end and a second open end;

(b) a first insert provided in said first open end of said hollow tube;

(c) a second insert provided in said second open end of said hollow tube;

(d) said first insert having a first passage configured to slidably receive said rod; and (e) said second insert having a second passage configured to slidably receive said rod.

12. An adjustable steady rest for a user aiming a firearm, comprising:

(a) a chassis, including a clamp mount leg, a span leg, and a clamping bracket;

(b) a clamp attached to said clamp mount leg and configured to clamp against said clamping bracket;

(c) a rod receiver attached to said chassis;

(d) a rod that is translatable with respect to said rod receiver, an amount of extension of said rod from said rod receiver being selectively adjustable by said user;

(e) a firearm support mounted on a distal end of said rod;

(f) said rod having a smooth, cylindrical exterior;

(g) a lock plate, including a passage configured to bind against said cylindrical exterior of said rod when said lock plate is tilted;

(h) a spring configured to bias said lock plate to said tilted position; and (i) a release configured to bias said lock plate away from said titled position.

13. The adjustable steady rest as recited in claim 12, wherein said clamp is a clamping screw.

14. The adjustable steady rest as recited in claim 13, wherein said clamping bracket is aligned with an axis of rotation of said clamping screw.

15. The adjustable steady rest as recited in claim 14, wherein said clamping bracket comprises:

(a) a first leg angularly offset 45 degrees in the anti-clockwise direction from said axis of rotation of said clamping screw; and (b) a second leg angularly offset 45 degrees in the clockwise direction from said axis of rotation of said clamping screw.

* * * * *